US011376751B2

(12) United States Patent
Rohrbach et al.

(10) Patent No.: US 11,376,751 B2
(45) Date of Patent: Jul. 5, 2022

(54) BLADE ASSEMBLY AND KNIFE THEREFOR

(71) Applicants: Martin Rohrbach, Goeggingen-Horn (DE); Kerry Henn, Solingen (DE)

(72) Inventors: Martin Rohrbach, Goeggingen-Horn (DE); Kerry Henn, Solingen (DE)

(73) Assignee: MARTOR KG, Solingen (DE)

( * ) Notice: Subject to any disclaimer, the term of this patent is extended or adjusted under 35 U.S.C. 154(b) by 99 days.

(21) Appl. No.: 16/795,847

(22) Filed: Feb. 20, 2020

(65) Prior Publication Data

US 2020/0276721 A1 Sep. 3, 2020

(30) Foreign Application Priority Data

Feb. 23, 2019 (DE) ..... 102019001282.8

(51) Int. Cl.
*B26B 1/04* (2006.01)

(52) U.S. Cl.
CPC ..... *B26B 1/046* (2013.01)

(58) Field of Classification Search
CPC ..... B26B 1/046; B26B 5/001; B26B 5/003; B26B 1/08; B26B 1/04; B26B 29/02; B26B 5/00; B23D 51/10
USPC ..... 30/161, 162, 125, 142, 293, 153, 155, 30/156, 157, 160, 331, 339, 342, 332, 30/333, 334, 165, 341; 7/118, 148
See application file for complete search history.

(56) References Cited

U.S. PATENT DOCUMENTS 2,017,895 A * 10/1935 Davey ..... B23D 51/01 30/517
2,137,800 A * 11/1938 Davey ..... B23D 51/10 30/517
4,947,551 A * 8/1990 Deisch ..... B26B 1/046 30/161
6,105,260 A * 8/2000 Parrish ..... B23D 51/10 30/331
6,112,420 A * 9/2000 Schickerling ..... B23D 51/10 279/77
7,055,248 B2 * 6/2006 Cote ..... A61B 17/3213 30/337
7,249,417 B2 * 7/2007 Chu ..... B26B 1/04 30/155

(Continued)

FOREIGN PATENT DOCUMENTS

CN 200977657 Y 11/2007
DE 29600185 U1 6/1997
WO 99/00224 A2 1/1999

*Primary Examiner* — Ghassem Alie
(74) *Attorney, Agent, or Firm* — Andrew Wilford

(57) ABSTRACT

A knife has two housing parts as well as a blade and a blade support. The support has a blade seat having a contact face normally engaging a blade face with the opposite blade face being freely accessible. The parts are movable between an operating position with the blade projecting and a stowed position with the blade wholly contained. A holder on the blade support secures the blade in the seat via interlocking formations that hold the blade against the contact face but that are so constructed that the blade has a degree of freedom in at least one direction in order to be detached from the blade seat. A latch on the holder has a bolt movable between a bolted position detachably fitted in the seat and holding the blade there and a released position out of the seat and allowing the blade to be replaced.

13 Claims, 13 Drawing Sheets

(56) References Cited

U.S. PATENT DOCUMENTS

| | | | | |
|---|---|---|---|---|
| 8,584,367 | B2 * | 11/2013 | Chu | B26B 1/04 30/151 |
| 8,978,254 | B1 * | 3/2015 | White | B26B 29/02 30/165 |
| 2005/0120564 | A1 | 6/2005 | Chen Lin | |
| 2006/0130339 | A1 | 6/2006 | Berus | |
| 2011/0197454 | A1 | 8/2011 | Zeng | |
| 2014/0366387 | A1 | 12/2014 | Schuft | |
| 2015/0258695 | A1 | 9/2015 | Schekalla et al. | |
| 2015/0360374 | A1 | 12/2015 | Gringer et al. | |
| 2016/0311121 | A1 | 10/2016 | Wang | |

* cited by examiner

BLADE ASSEMBLY AND KNIFE THEREFOR

FIELD OF THE INVENTION

According to a first aspect, the invention relates to a blade assembly comprising a blade support and a blade. Such blade assemblies are usually part of knives, in particular utility knives.

The blade assembly e.g. comprises a blade support and a blade that can be detachably fastened in the blade support. The blade support is provided with a blade seat having a contact face for a first blade face. A second blade face opposite the first blade face is substantially freely accessible or abuts a contact face of the blade cover.

The blade support has a holder for holding the blade in the blade seat, comprising first interlocking formation associated with the blade support and second interlocking formation associated with the blade that interlock and hold the blade at least in a plane parallel to the contact face. The interlocking formation are designed such that the blade has at least one degree of freedom in one direction in order to be detached from the blade seat.

The blade can e.g. be mounted between a contact face of the blade support and a contact face of a blade cover retained on the blade support. Alternatively, a blade cover may not be provided, such that a blade face of the blade abuts a contact face of the blade support and the opposing blade face is open.

The holder has a latch having at least one bolt element that is movable between a bolted position and a released position, engages over a region of the second blade face or the blade cover, and locks movement of the blade in the direction of the degree of freedom. In other words, it is not possible to move the blade out of the blade seat in the bolted position of the latch, since the degree(s) of freedom of the blade is/are blocked by the bolt. The latch is e.g. retained on the blade support. The bolt may directly engage over at least one region of the second blade face or may engage over at least one region of a blade cover, wherein the blades The first interlocking formation and the second interlocking formation are e.g. designed such that the blade has only one degree of freedom in the pivoting direction. The bolt may e.g. be in contact with the blade at an end remote from the pivot axis, such that, due to the lever arm, low retaining forces are required to retain the blade securely in its blade seat.

The first interlocking formation e.g. comprise at least one projection that interlockingly interacts with a complementary cut-out of the second interlocking formation, such that the blade can be threaded onto the projection by the cut-out. For example, the first interlocking formation comprise two projections, each projection interlockingly interacting with a cut-out of the blade. In this case, the blade support thus has e.g. two projections and the blade has two cut-outs.

The first interlocking formation comprise e.g. at least one hook-shaped projection of the blade support that detachably engages through a cut-out of the blade, the shape of the cut-out approximately corresponding to the cross section of the hook-shaped projection. The blade is e.g. detachably arranged between a surface of the projection facing the second blade face and a contact face of the blade support.

According to an embodiment of the invention, the blade is detachably arranged between a holding surface of the projection facing the second blade face and a contact face of the blade support.

An embodiment is characterized in that the bolt element is designed as a wire or plate. In this way, the bolt provides a small surface area for depositing particles, which could impair the function of the knife. Within the meaning of the invention, the terms "wire" or "plate" are to be understood to mean that they may consist of a metal, but that other material, such as plastics materials or composite materials, also come into consideration for this purpose. The properties according to which, for example, a small deposit surface is formed and/or according to which good spring properties of the material are provided, as is the case for certain metals, for example, are essential.

The bolt is designed as a spring, for example. For example, the bolt is formed by a first leg of a torsion spring.

The bolt e.g. has a bolt region and a bearing region, the bearing region being movably mounted in a bearing receptacle of the blade support. For example, the bearing region is pivotally mounted in the bearing receptacle. The bearing region is e.g. formed by a second leg of a torsion spring that is pivotally retained in a bearing receptacle of the blade support.

The bolt can e.g. be detachably brought into engagement with a receptacle that is retained on the blade support. For example, the receptacle has a seat for the bolt element. The bolt is e.g. retained in the seat such that it cannot become inadvertently detached from the seat. For example, a region of the bolt is latched in the seat. Alternatively or additionally, the bolt is loaded into the seat by a spring force.

For example, the receptacle is provided with an oblique surface that, when the bolt moves into the seat, deflects a force that acts on the bolt element in a first direction, in a second direction that is directed orthogonally to the second blade face. The force may be formed by a spring force, for example. In this way, the blade is loaded by the bolt against the contact face of the blade seat.

The projection e.g. simultaneously forms the receptacle for the bolt element when it is arranged in the bolted position. In this case, a separate element for the seat of the bolt element does not have to be produced. In this way, space can also be freed up for structural elements on the blade support.

In the bolted position, the bolt element for example surrounds the blade or engages through a cut-out of the blade and abuts the second blade face.

The invention also relates to a knife having a blade assembly 10 according to the first aspect of the invention.

The knife has, for example, a mechanism having a first part and a second part that is movable relative to the first part in order to move a blade assembly between a stowed position in which a blade of the blade assembly is moved relative to a protector such that the user cannot come into contact with a cutting edge of the blade assembly and an operating position which the blade is moved relative to the protector such that a cutting process is possible.

In terms of the advantages of the knife, reference is made to the advantages of the first aspect of the invention.

One embodiment of the invention is described by way of example in the following description of the figures, also with reference to the schematic drawings. Here, for the sake of clarity, even if different embodiments are involved, identical or comparable parts or elements have been denoted by identical reference signs, sometimes with the addition of lower case letters.

Features that are only described, set out or disclosed in relation to one embodiment can also be provided in any other embodiment of the invention within the scope of the invention. Even if they are not shown in the drawings, such amended embodiments are covered by the invention.

All the features disclosed are essential to the invention per se. The content of the disclosure of the cited documents and the prior art devices described are hereby incorporated into the disclosure of the application in their entirety, also for the purpose of incorporating individual features or a plurality of features of the subjects disclosed therein into one or more claims of the present application. Even if they are not shown in the drawings, such amended embodiments are also covered by the invention.

SPECIFIC DESCRIPTION OF THE INVENTION

Figure 1:
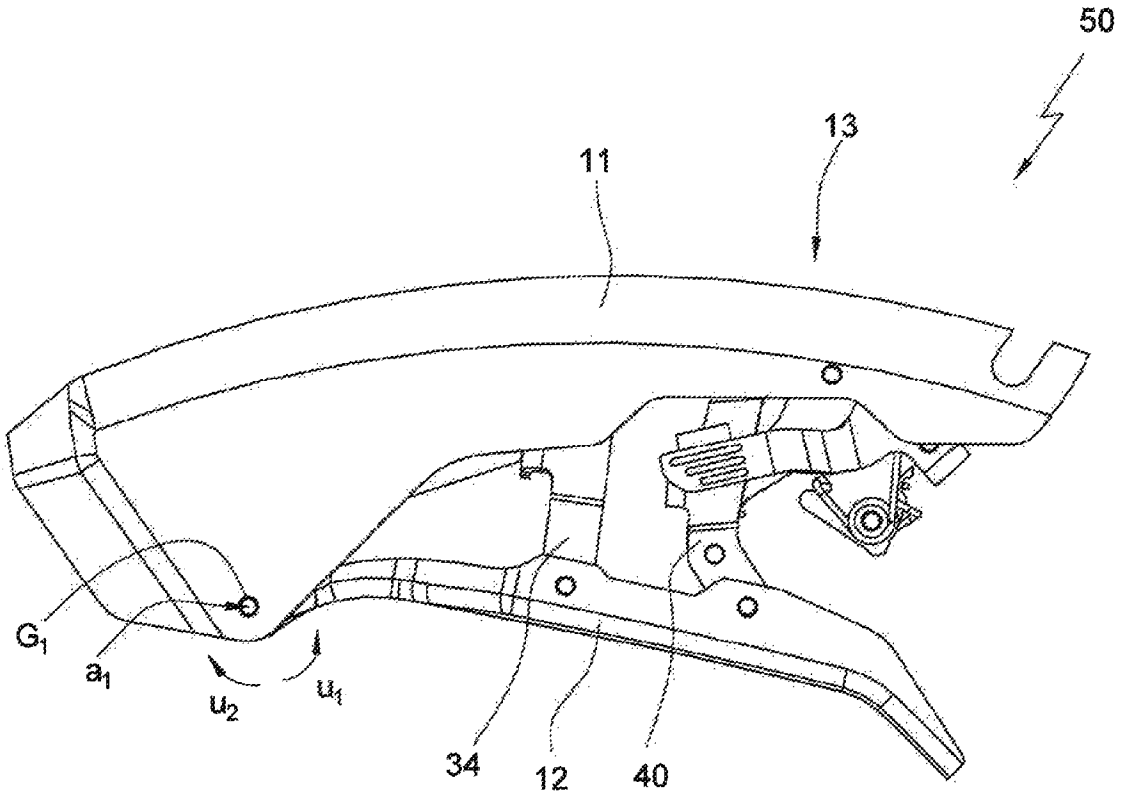
FIG. 1 is a side view of a knife in the stowed position.

The knife as a whole according to FIG. 1 is denoted by reference sign 10 in the drawings.

Figure 2:
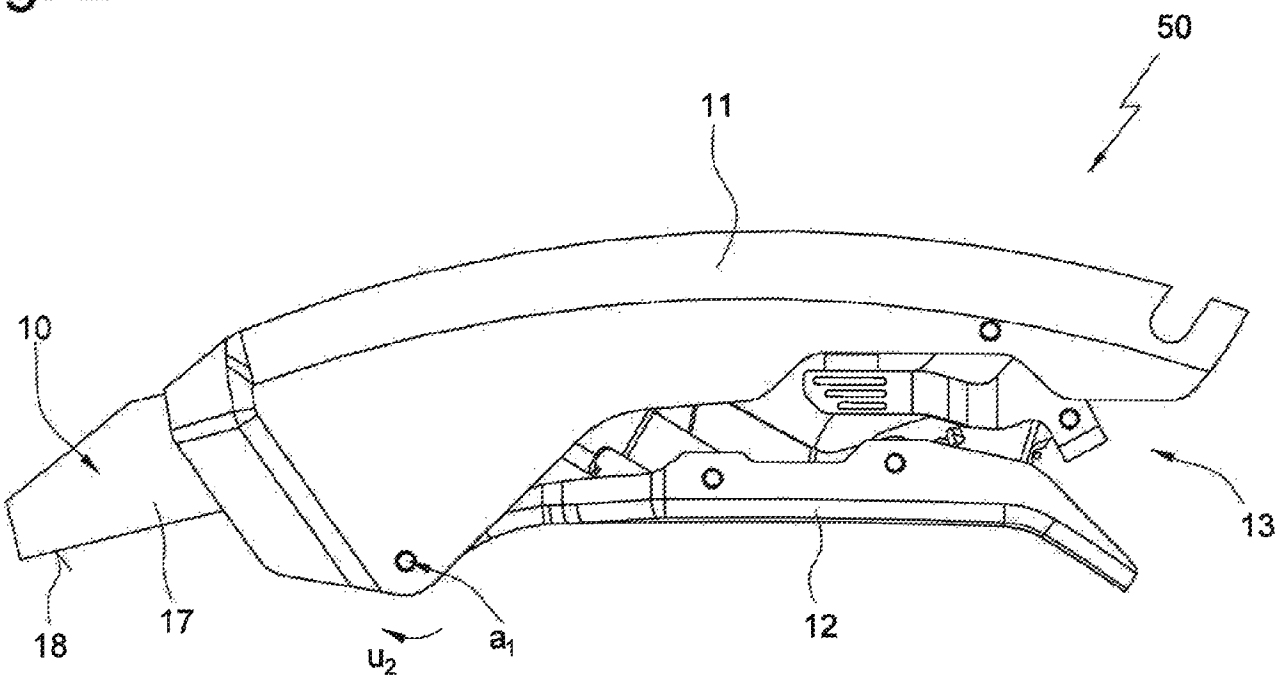
FIG. 2 is a side view of the knife in an operating position.
Figure 3:
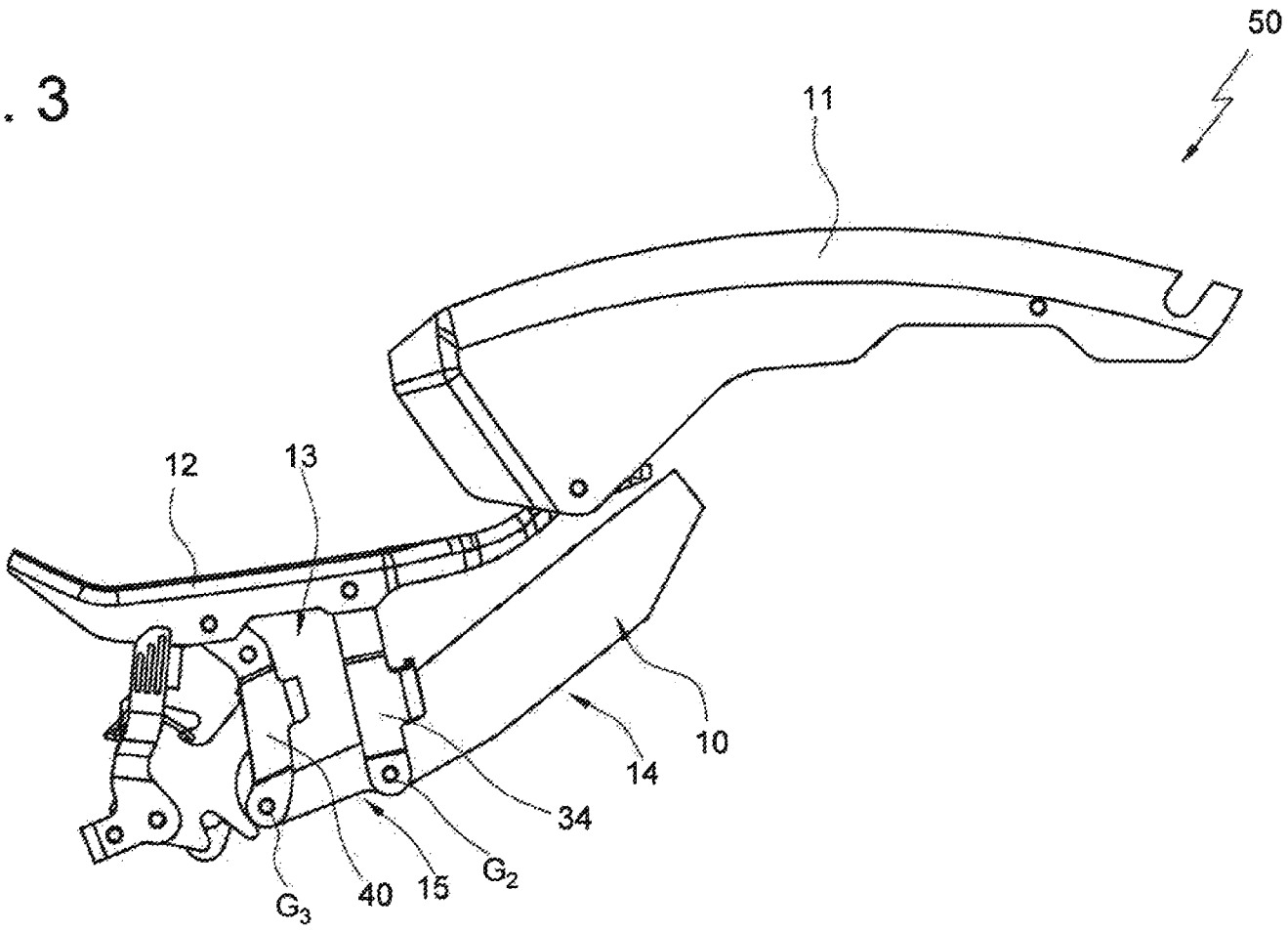
FIG. 3 is a side view of the knife in a blade-changing position.

The knife 10 comprises a first part 11 and a second part 12. The first part 11 and the second part 12 are part of a mechanism 13 that can move a blade assembly 40 having a blade support 14 and a blade 17, can be moved between a stowed position and an operating position. The stowed position is shown in FIG. 1. Owing to movement of the second part 12 in the direction $u_1$ about a pivot axis $a_1$ relative to the first part 11, the blade support 14 can be pivoted from the stowed position into an operating position. The operating position is shown in FIG. 2. The second part 12 can be moved relative to the first part 11 in the direction $u_2$ out of the stowed position according to FIG. 1, the knife 10 being moved into a blade-changing position according to FIG. 3. In the blade-changing position, the blade support 14 is accessible and the blade can be changed.

Figure 4:
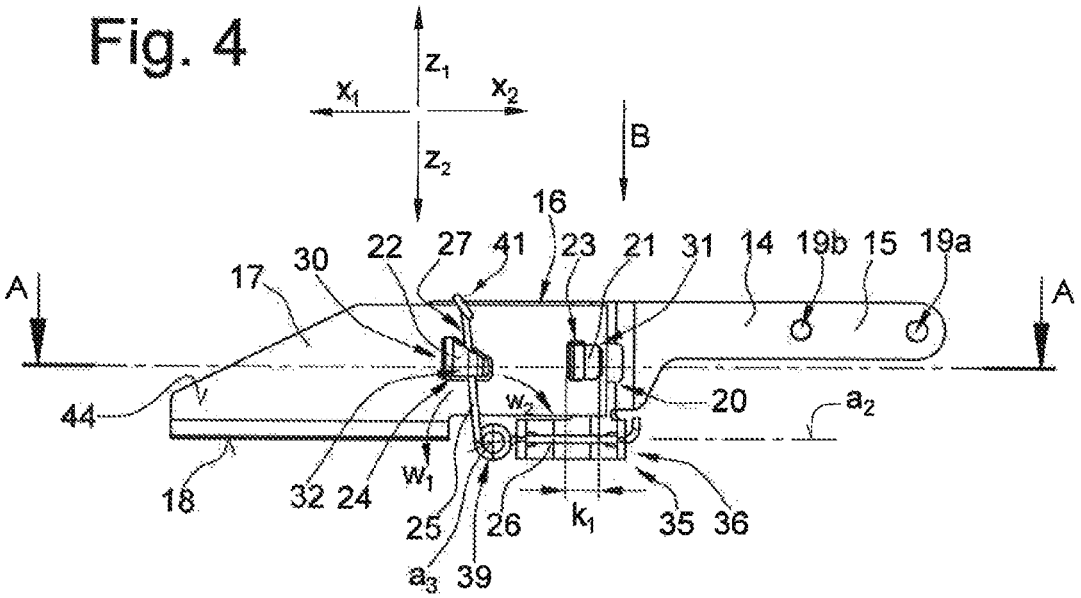
FIG. 4 is a side view of a blade assembly of the knife, having a blade support and a blade retained thereon, a latch being in a bolted position.

According to FIG. 4, the blade support 14 has a rear projection 15 for articulated support on the mechanism 13. In order to form the pivot joints, the projection 15 has openings 19*a* and 19*b*. In addition, the blade support 14 has a blade seat 16 for fastening a blade 17 that is provided with a cutting edge 18, and a first blade face 43 and a second blade face 44 opposite the first blade face 43. A latch 30 detachably secures the blade 17 to the blade support 14. Projections 21 and 22 are retained on the blade support 14 that, in the present embodiment, are cut out from the blade support 14 and project out of a plane E of the blade seat that has an x/z direction, such that they have a region projecting in the direction $y_1$ and a region that is parallel to the plane E. The projections 21 and 22 engage through cut-outs 23 and 24 in the blade 17. The projection 22 forms a seat 45.

Figure 5:
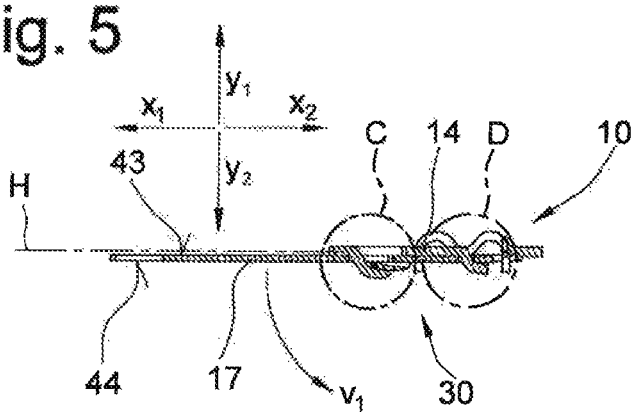
FIG. 5 is a sectional view along sectional line A-A in FIG. 4.
Figure 6A:
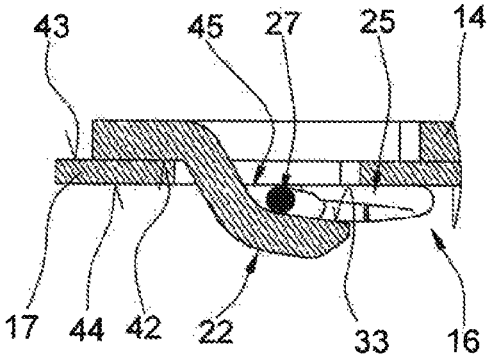
FIG. 6*a* is a detail according to detail line C in FIG. 5.
Figure 6B:
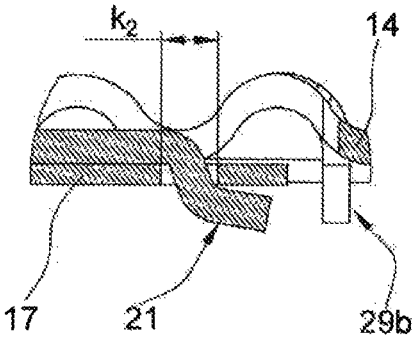
FIG. 6*b* is a detail according to detail line D in FIG. 5.
Figure 7A:
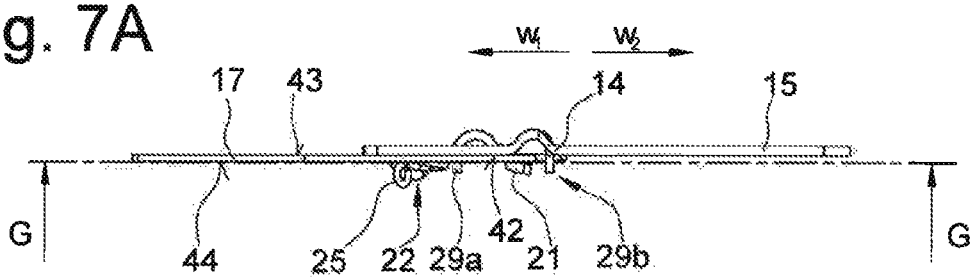
FIG. 7*a* is a view from the direction of the arrow B in FIG. 4.
Figure 7B:
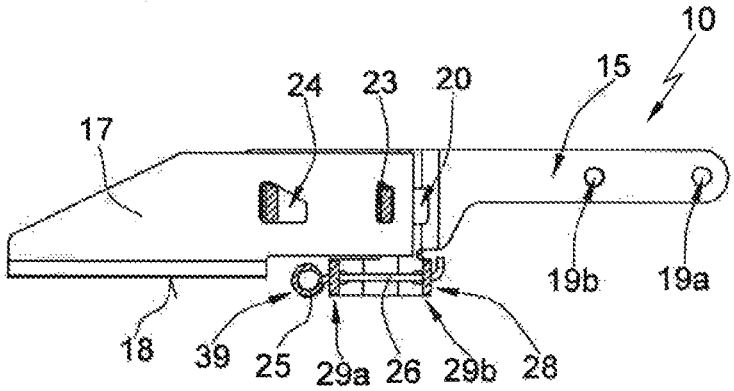
FIG. 7*b* is a section taken along section line G-G of FIG. 7*a;*

A region 31 of the projection 21 extending in parallel with the plane E has a width K1 that is greater than the width K2 of the opening 23. The cross section of the projection 21 approximately corresponds to the dimensions of the cut-out 23 in the x direction and z direction, or is slightly smaller. For this reason, the blade 17 cannot readily be detached from the projection 21 in the direction $y_1$. Instead, a pivoting movement of the blade in the direction $v_1$ according to FIG. 5 is required. The cut-out 24 in the blade is formed such that the blade 17 can be moved away over the region 32 of the projection 22 when pivoting in the direction $v_1$. The pivoting guidance is predetermined by the shape of the projection 21.

A bolt that prevents movement of the blade 17 in the direction $v_1$ is arranged between a holding surface 33 of the projection 22 and the outer surface 44 of the blade 17 (see FIG. 4). In the present embodiment, the bolt is formed by a leg 27 of a spring 25, the other leg 26 of which is pivotally retained in a bearing device 35 of the blade support 14.

Figure 8:
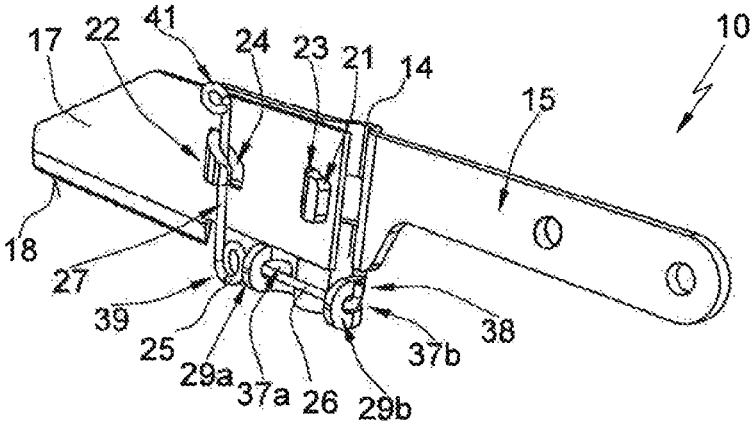
FIG. 8 is an oblique perspective rear view of the blade support according to FIG. 4.
Figure 9:
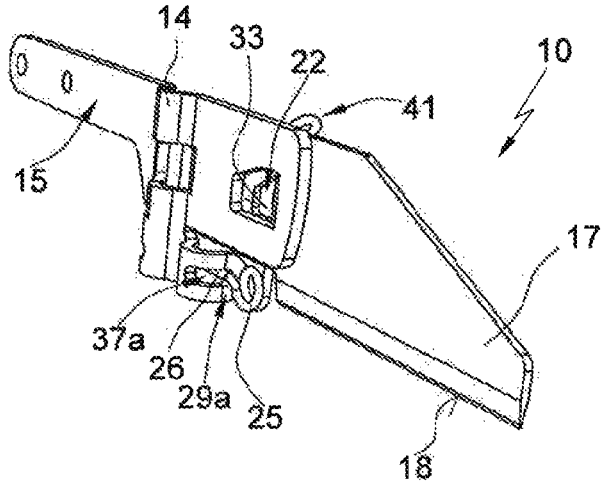
FIG. 9 is an oblique perspective front view of the blade support according to FIG. 4.
Figure 10:
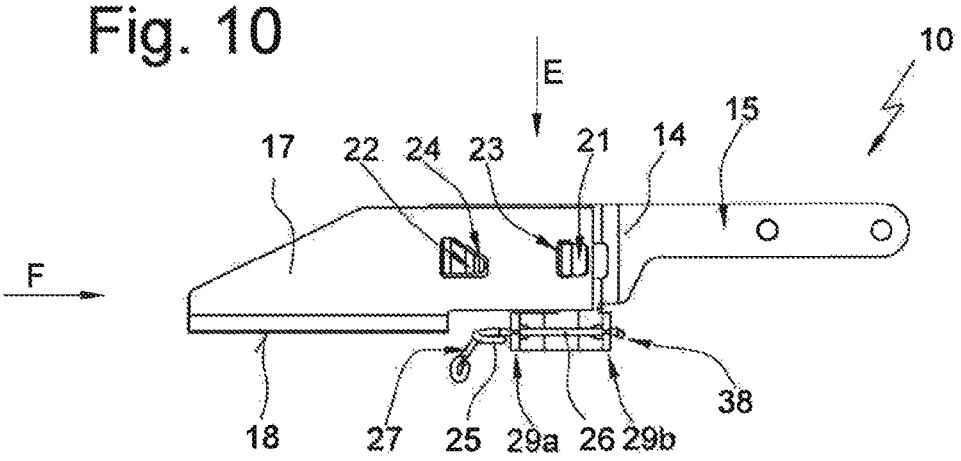
FIG. 10 is a side view of the blade support according to FIG. 4, a latch being in the released position.
Figure 11:
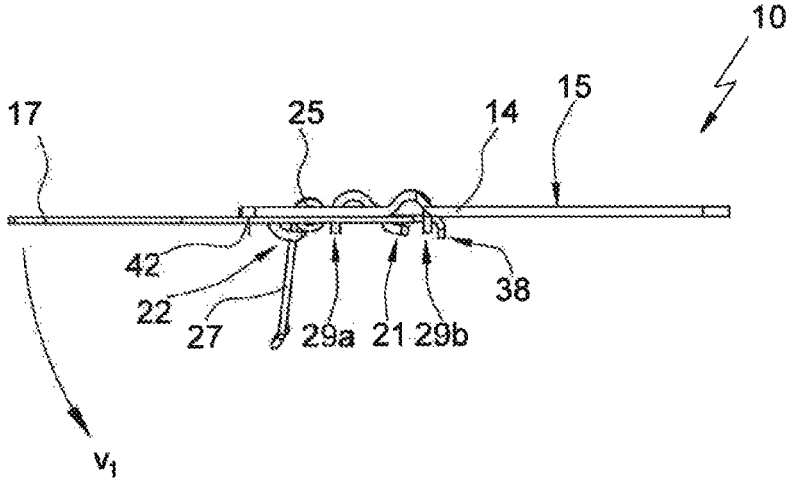
FIG. 11 is a view from the direction of the arrow E in FIG. 10.
Figure 12:
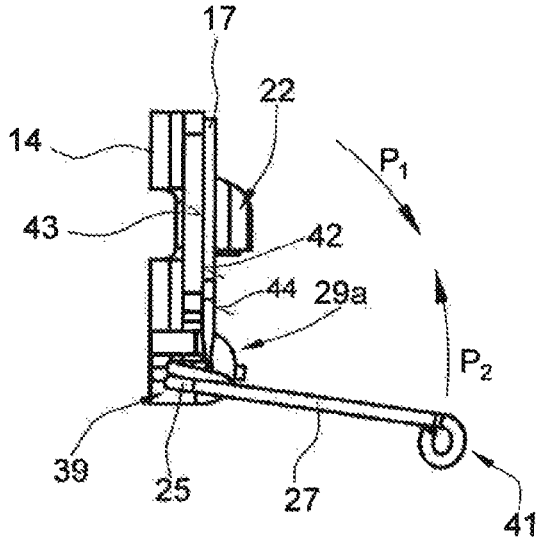
FIG. 12 is a view from the direction of the arrow F in FIG. 10.
Figure 13:
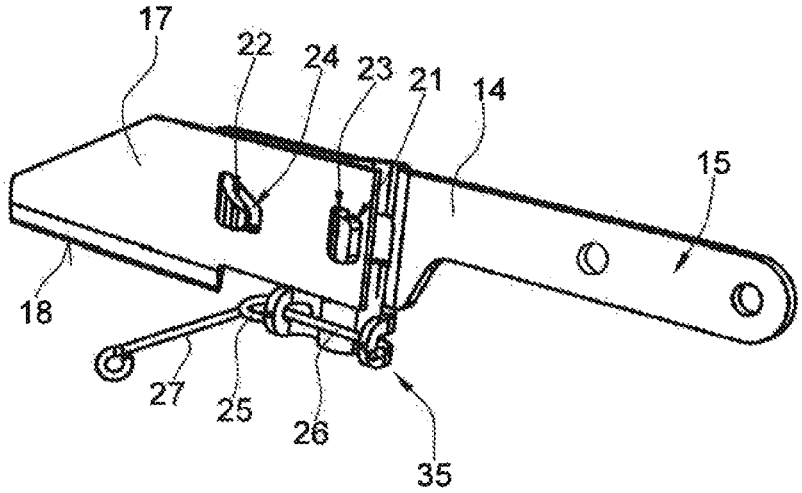
FIG. 13 is an oblique perspective rear view of the blade support according to FIG. 10, FIGS. 14*a* to 14*d* show the method for mounting the blade on the blade support.

In the present embodiment, the bearing device 35 has a projection 36 of the blade support 14 (see e.g. FIG. 8), from which two arms 29*a* and 29*b* project in the direction $y_1$. An opening 37*a* is formed in the arm 29*a* and an opening 37*b* is formed in the arm 29*b*. The openings 37*a* and 37*b* align with one another. The leg 26 engages through the openings 37*a* and 37*b*, such that a pivot axis a2 is formed, about which the spring 25 can be pivoted. An end region 38 of the leg 26 is approximately bent at right angles to the longitudinal extension of the leg 26 such that the spring 25 cannot be detached from the bearing device 35. A wound central region 39 of the spring 25 prevents movement of the spring in the direction x by the contact with the arm 29*a*.

An end region 41 of the spring leg 27 is bent such that it can be easily grasped, making it easy for the user to actuate.

The spring leg 27 is subjected to pretension about a pivot axis $a_3$ of the spring 25 in the direction w1 in engagement with the projection 22. Owing to movement of the leg 27 counter to the spring force in the direction w2 and subsequent pivoting about the pivot axis a2 in the direction p1 into the position shown in FIGS. 10 to 13, the locking can be released such that the blade 17 can be removed from the blade seat 16.

In the unlocked position according to FIGS. 10 to 13, the blade 17 only has one degree of freedom in the pivoting direction $v_1$. The blade can then be removed from the blade seat 16 by pivoting in the direction $v_1$ and can optionally be replaced with another blade 17.

Figure 14A:
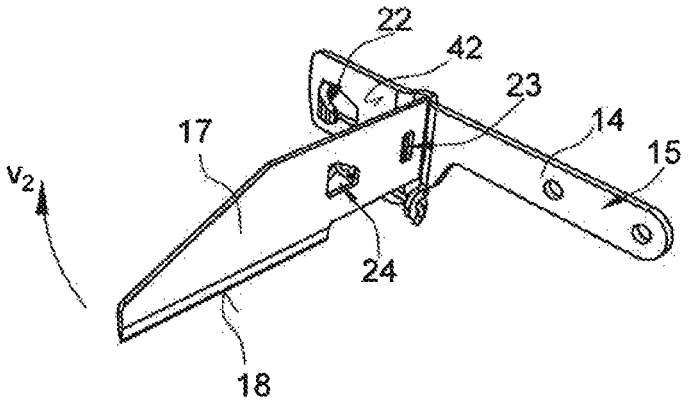
Figure 14B:
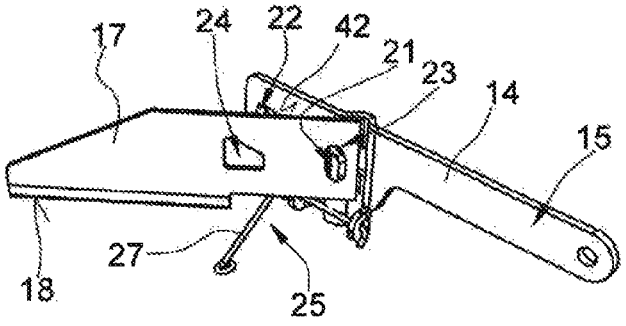
Figure 14C:
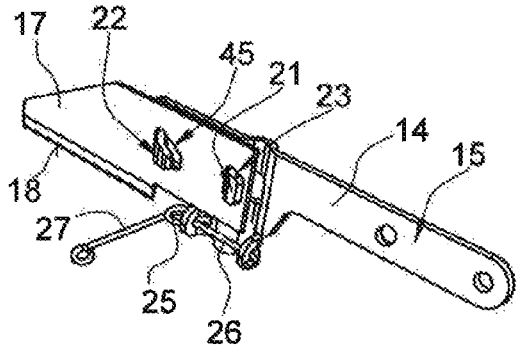
Figure 14D:
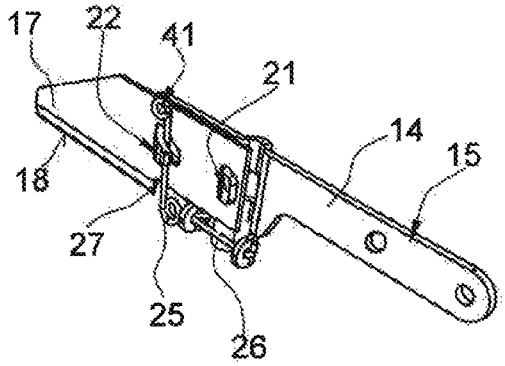
Figure 15:
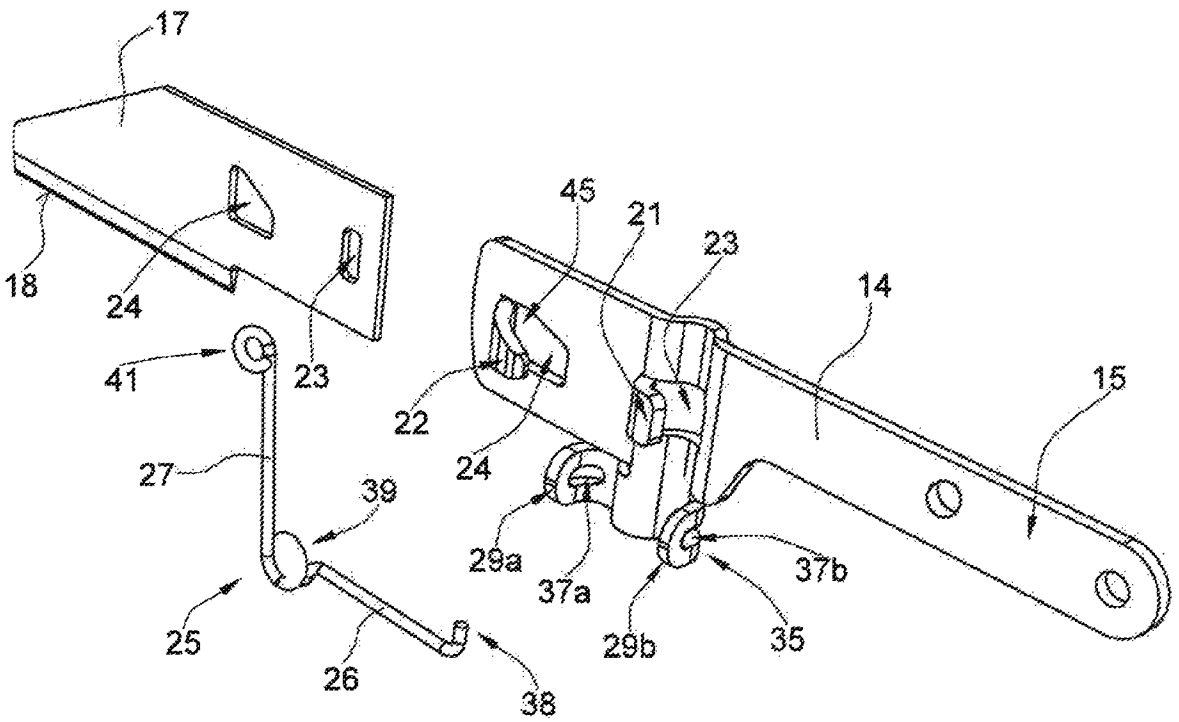
FIG. 15 is an exploded view of the blade support.
Figure 16:
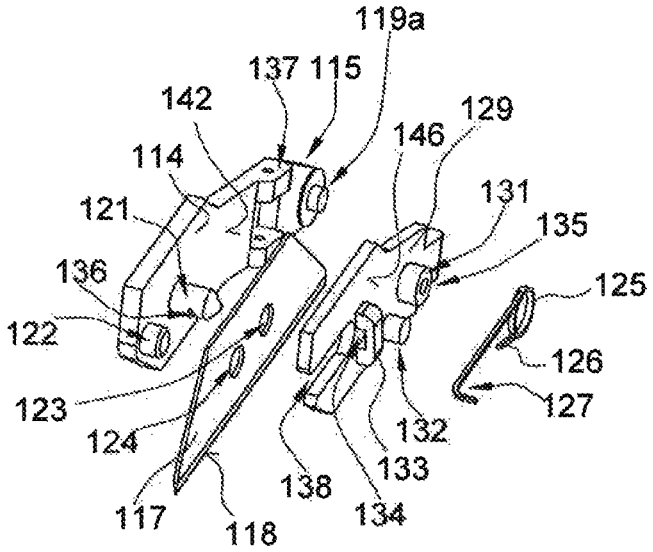
FIG. 16 is an exploded view of a second embodiment of the blade support.
Figure 17:
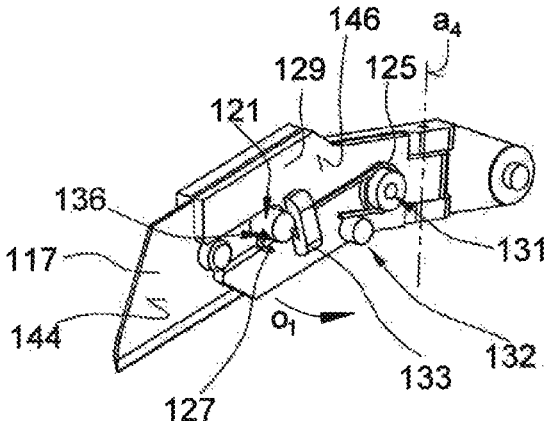
FIG. 17 is a perspective view of the blade support, the latch being in a bolted position.

The blade 17 can be mounted again by, according to FIG. 14*a*, the cut-out 23 being brought into engagement with the projection 21 and the blade 17 then being pivoted onto the projection 21 in the direction $v_2$ (see FIGS. 14*b* and 14*c*) until the projection 22 engages through the cut-out 24 and the first blade face 43 comes into contact with the contact face 42.

The leg 27 of the spring 25 is then pivoted about the axis a2 in the direction p2 and latches in the seat 45 of the projection 22 by the leg 27 being pivoted somewhat counter to the force of the spring 25 in the direction w2 and then being inserted into the seat 45 in the direction w1.

The holder 20 according to the invention having the latch 30 is not vulnerable to dirt, since there are barely any structural design aspects, such as undercuts, angles, etc., that promote the accumulation of particles.

A second embodiment of a blade assembly 140 is shown in FIGS. 16 to 22. Since the knife can be designed in substantially the same way as the first embodiment, except for the blade assembly 140, the remaining parts are not described.

The blade assembly 140 has a blade support 114 and a blade cover 129. A central longitudinal axis of the blade assembly 140 is denoted by m. The blade support 114 and the blade cover 129 are parts of a holder 120 for a blade 117. According to FIG. 16, the blade support 114 has a rear projection 115 on which bearing pins 119*a* and 119*b* are formed. The blade support 114 is provided with a blade 116, comprising a contact face 142 of the blade support 114. Pins 121 and 122 project from the blade support 114. The pin 121 has a notch 136. A bearing region 137 of the blade support 114 is provided for pivotally mounting the blade cover 129.

The blade 117 has a cutting edge 118 and two cut-outs 123 and 124. The blade 117 is e.g. designed as a strip steel blade or ceramic blade. A blade face 143 of the blade 117 interacts with the contact face 142 and a blade face 144 of the blade 117 interacts with a contact face 141 of the blade cover 129 when the blade 117 is in the bolted position in the blade seat 116.

A spring 125 that is designed as a torsion spring in the present example, is part of a latch 130. It has two end regions 126 and 127. The spring 125 is mounted on the blade assembly 140 by a bearing device 135. Here, a bearing region 128 that is designed as a bearing pin 131 and is arranged coaxially with the wound region of the torsion spring is provided on the blade cover 129. The end region 127 is supported on a stop 132 of the blade cover 129 under pretension. The blade cover 129 also has a projection 133 having a link 134 that is in the form of an opening in the projection 133 here and is provided for restricting the movement of the end region 127 of the spring 125. The link could, however, alternatively be omitted.

Figure 22:
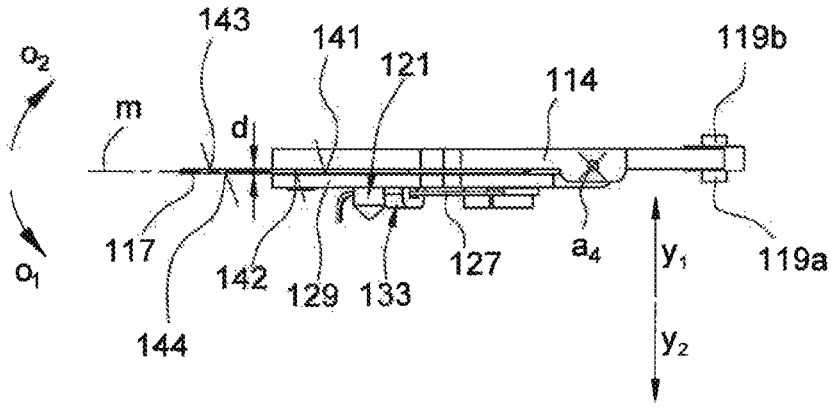
FIG. 22 is a view from the direction of the arrow G in FIG. 20.

The blade cover 129 forms a contact face 141 that is shown in FIG. 22.

Figure 18:
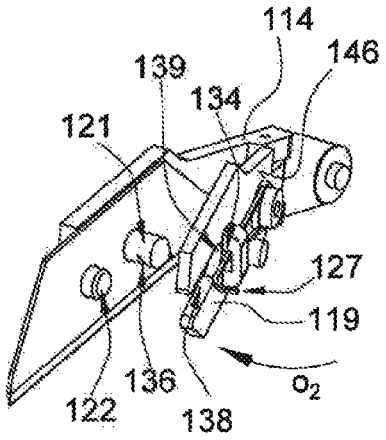
FIG. 18 is a perspective view of the blade support, the latch being in the released position.
Figure 19:
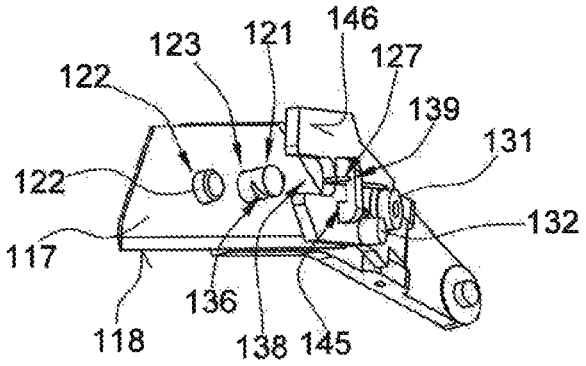
FIG. 19 is a perspective view of the blade support, the latch being in the released position.
Figure 20:
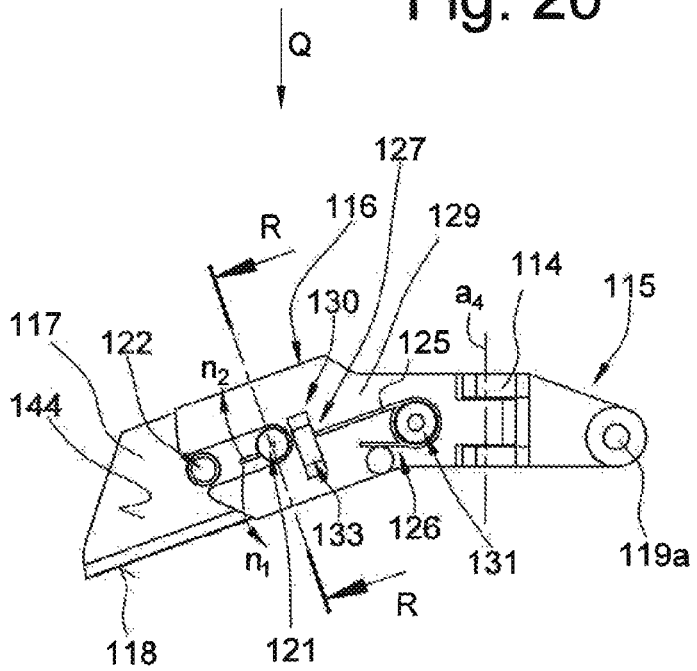
FIG. 20 is a side view of the blade support in the bolted position of the latch.
Figure 21:
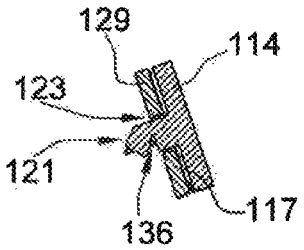
FIG. 21 is a sectional view along sectional line F-F in FIG. 20.

When a blade 117 is mounted in the blade seat 116 such that the blade face 143 abuts the contact face 142, and the projection 121 engages through the cut-out 123 and the projection 122 engages through the cut-out 124, the blade cover 129 can be pivoted in a direction $o_2$ out of the open position according to FIGS. 18 and 19 about a pivot axis $a_4$ into the closed position according to FIGS. 17 and 20 to 22 which the projection 121 engages through a cut-out 138 in the blade cover 129. Owing to the pretension of the spring 125, the end region 127 abuts an upper end region 139 of the link 134. The end region of the link 134 opposite the end region 139 is denoted by 145.

By the end region 127 being somewhat deflected in the direction $n_1$, it can be inserted into the notch 136. The latch 130 is then in the bolted position, i.e. the blade cover 129 is prevented from moving in the direction $o_1$ into the open position by the end region 127 acting as a bolt. The end region 127 extends over a region of an outer surface 146 of the blade cover 129 and abuts the outer surface 146.

The notch 136 is arranged on the projection 121 such that the end region 127 has to be moved counter to spring force in the direction $n_1$ in order to move it out of the notch 136. In this way, the end region 127 is not inadvertently released from engagement with the notch 136.

The notch 136 is designed such that it forms a movement converter, such that the spring force exerted by the end region 127 in the direction $n_2$ is partially diverted into a force that loads the end region 127 in the direction $y_1$ (see FIG. 22), such that said region exerts a force on the blade cover 129 in the direction $o_2$. In this way, the blade 117 is securely retained between the contact faces 142 and 141 and blades 117 having different thicknesses D can be securely fastened in the blade seat 116.

The invention claimed is:

1. A knife comprising:

a first part;

a second part;

a blade having first and second blade faces;

a blade support carried on one of the parts, on which the blade is detachably fastened, and that has a blade seat having a contact face for engageable with the first blade face, the second blade face being opposite the first blade face and substantially freely accessible, the first and second parts being movable between an operating position with the blade projecting from the parts and a stowed position with the blade wholly contained between the parts;

a holder on the blade support for holding the blade in the blade seat and having a first interlocking formation on the blade support and a second interlocking formation on the blade and that interlockingly holds the blade at least in a plane parallel to the contact face, the interlocking formations being so constructed that the blade has a degree of freedom in at least one direction in order to be detached from the blade seat; and a latch on the holder and having at least one bolt movable between a bolted position detachably fitted in the seat and a released position out of the seat and engaging over a region of the second blade face or a blade cover in the bolted position to block movement of the blade in the one direction.

2. The knife wherein the first interlocking formation and the second interlocking formation are designed such that the blade has only one degree of freedom in the one direction.

3. The knife according to claim 1, wherein one of the interlocking formations is a projection and the other interlocking formation is a complementary cut-out, whereby the blade is locked in the seat by engagement of the projection into the cut-out.

4. The knife according to claim 1, wherein the first interlocking formation comprises a hook-shaped projection that detachably engages through a cut-out of the blade, the shape of the cut-out approximately corresponding to a cross section of the hook-shaped projection.

5. The knife according to claim 4, wherein the blade is detachably gripped between a holding surface of the hook-shaped projection facing the second blade face and a contact face of the blade support.

6. The knife according to claim 1, wherein the movable bolt is a spring.

7. The knife according to claim 1, wherein the bolt forms a bolt region and a bearing region.

8. The knife according to claim 1, wherein the seat is provided that deflects a force that acts on the bolt in a first direction into a second direction orthogonal to the second blade face.

9. The knife one according to claim 1, wherein the bolt engages through a cut-out of the blade and is in contact with an edge region of the second blade face adjacent to the cut-out.

10. The assembly knife according to claim 1, wherein the blade support has a blade cover.

11. The knife according to claim 10, wherein the blade cover is pivotally mounted on the blade support.

12. A knife comprising:

a first part;

a second part;

a blade having first and second blade faces;

a blade support carried on one of the parts, on which the blade is detachably fastened, and that has a blade seat having a contact face engageable with the first blade face, the second blade face being opposite the first blade face and substantially freely accessible, the first and second parts being movable between an operating position with the blade projecting from the parts and a stowed position with the blade wholly contained between the parts;

a holder on the blade support for holding the blade in the blade seat and having a first interlocking formation on the blade support and a second interlocking formation on the blade that interlockingly holds the blade at least in a plane parallel to the contact face, the interlocking formations being so constructed that the blade has a degree of freedom in at least one direction in order to be detached from the blade seat; and a latch on the holder and having at least one bolt movable between a bolted position and a released position and engaging over a region of the second blade face or a blade cover in the bolted position to block movement of the blade in the direction of the degree of freedom, the bolt being is designed as a wire or a plate.

13. A knife comprising:

a first part;

a second part;

a blade having first and second blade faces;

a blade support carried on one of the parts, on which the blade is detachably fastened, and that has a blade seat having a contact face engageable with the first blade face, the second blade face being opposite the first blade face and substantially freely accessible, the first and second parts being movable between an operating position with the blade projecting from the parts and a stowed position with the blade wholly contained between the parts;

a holder on the blade support for holding the blade in the blade seat and having a first interlocking formation on the blade support and a second interlocking formation on the blade that interlockingly holds the blade at least in a plane parallel to the contact face, the interlocking formations being so constructed that the blade has a degree of freedom in at least one direction in order to be detached from the blade seat;

a seat on the blade support; and a latch on the holder and having at least one bolt formed as a wire or a plate, movable between a bolted position detachably fitted in the seat and a released position disengaged from the seat, and engaging over a region of the second blade face or a blade cover in the bolted position to block movement of the blade in the direction of the degree of freedom.

* * * * *